United States Patent [19]

Yokoe et al.

[11] Patent Number: 4,719,865

[45] Date of Patent: Jan. 19, 1988

[54] SEWING MACHINE WITH THREAD TAKE-UP MECHANISM

[75] Inventors: Masaaki Yokoe, Nagoya; Yoshikazu Kurono, Aichi; Koji Hayashi; Miho Hashimoto, both of Nagoya, all of Japan

[73] Assignee: Brother Kogyo Kabushiki Kaisha, Nagoya, Japan

[21] Appl. No.: 931,462

[22] Filed: Nov. 14, 1986

[30] Foreign Application Priority Data

Nov. 20, 1985 [JP] Japan ..... 60-261658

[51] Int. Cl.[4] ..... D05B 69/00; D05B 47/00; D05B 1/12

[52] U.S. Cl. ..... 112/221; 112/163; 112/241

[58] Field of Search ..... 112/163, 164, 165, 221, 112/241, 245, 246

[56] References Cited

U.S. PATENT DOCUMENTS

| | | | |
|---|---|---|---|
| 690,004 | 12/1901 | Ammerman | 112/245 |
| 2,191,129 | 2/1940 | Landis | 112/111 |
| 2,667,135 | 1/1954 | Bell | 112/245 |
| 3,884,165 | 5/1975 | Tajima | 112/83 |
| 4,075,958 | 2/1978 | Sacchetti | 112/163 |
| 4,254,721 | 3/1981 | Teetz et al. | 112/221 |
| 4,301,756 | 11/1981 | Teetz et al. | 112/221 |
| 4,546,712 | 10/1985 | Willenbacher | 112/221 X |

FOREIGN PATENT DOCUMENTS

| | | | |
|---|---|---|---|
| 2070653 | 9/1981 | United Kingdom | 112/163 |

*Primary Examiner*—Wm. Carter Reynolds
*Attorney, Agent, or Firm*—Jordan and Hamburg

[57] ABSTRACT

A sewing machine with thread take-up mechanism is so constructed as to vertically move a take-up member, supported on a needle bar in such a manner as to be vertically movable at a timing which is different from that of the movement of the needle bar on which the take-up member is moved. The take-up member has a hole through which a thread being lead to the sewing needle is inserted.

7 Claims, 17 Drawing Figures

SEWING MACHINE WITH THREAD TAKE-UP MECHANISM

BACKGROUND OF THE INVENTION

1. Field of the Invention

The present invention relates to a sewing machine with thread take-up mechanism which takes up a thread being led to a sewing needle to apply tension to the thread forming the stitches.

2. Description of the Prior Art

A conventional take-up mechanism is shown in U.S. Pat. No. 3,884,165. This take-up mechanism has a take-up lever located at an upper position of a needle bar and pivotally moved by a gear, and is adapted to take up the thread being led to the needle by reciprocal movement of the take-up lever in the vertical direction. Thus, with this conventional mechanism, since the take-up lever is located upward of the needle bar and away therefrom and is adapted to move pivotally, the distance between the take-up lever and the needle eye is great and also the directions of movement of the take-up lever and the needle bar are different from each other. As a result, when the thread is taken up, the thread is stretched largely between the take-up lever and the needle eye when the thread is made of a certain material, so that insufficient and unstable tension is applied to the thread forming the stitches. In addition, the conventional mechanism suffered from the problem that the whole mechanism becomes so large.

Further, U.S. Pat. No. 4,546,712 shows a take-up mechanism with a complicated structure comprising a take-up lever provided with a plurality of thread guiding fingers, and a plurality of hook-shaped thread catching levers. With this device, one of a plurality of threads is selected to be used in the sewing. However, during the sewing, all the threads are vertically moved together with the thread guiding fingers while the threads are brought into sliding contact with the inner peripheral surfaces of the eyes of the thread guiding fingers. Therefore, this arrangement of the take-up mechanism adversely affect the threads.

Furthermore, U.S. Pat. No. 2,191,129 shows a sewing machine in which a guide eye is directly formed in the upper end of the needle bar. In this machine, said guide eye takes up the thread in cooperation with a tension device disposed between the needle bar and the bobbin. Therefore, with this arrangement of take up device, the timing and stroke of the vertical movement of the needle bar and those of the thread taking-up action by the guide eye accord with each other. Although this feature raises no problem when the sewing machine is of the single yarn chain stitch sewing machine type, as in the case of this U.S. Pat. No. 2,191,129, wherein the amount of thread taken up is small and also no accurate timing of the taking up action is required, it is disadvantageous when the machine is of another type such as a lock stitch sewing machine because, in such a case, no proper stitches can be formed.

SUMMARY OF THE INVENTION

It is the main object of the invention to provide a sewing machine with thread take-up mechanism which provides a reduced distance between the take-up member and the sewing needle, thus making the tension applied to the thread forming the stitches stable, and thereby allowing adequately good stitches to be formed, and which also provides an arrangement wherein the take-up member and the needle bar are disposed at the same locations, thereby allowing the arm of the machine frame to be made compact.

Another object of the invention which is related to the above main object is to provide a mechanism which is capable of providing the above-mentioned advantages for a sewing machine provided with a plurality of needle bars.

It is a further object of the invention to provide a device which is, in a sewing machine provided with a plurality of needle bars, capable of retaining in a stationary condition needle threads which are kept in a rest condition not having been selected for use, thereby preventing any adverse effect on these threads.

In order to achieve the above main object of the invention, a sewing machine in accordance with a first aspect of the invention comprises: a frame; a needle bar movably supported on the frame in the vertical direction and having a sewing needle at the lower end thereof; means for driving the needle bar; a take-up member movably supported on the needle bar and having a hole for a needle thread; and means for driving the take-up member with a timing different from that of the vertical movement of the needle bar.

In order to achieve the above other object of the invention which is related to the main object, a sewing machine in accordance with a second aspect of the invention comprises: a frame; a case member movably supported on the frame in the lateral direction; a plurality of needle bars movably supported on the case member in the vertical direction respectively, each of which having needle at the lower end thereof; case member driving means for laterally moving the case member in order to bring one of the plurality of needle bars into a sewing position; take-up members movably supported on the needle bars respectively and having a hole for a needle thread; and take-up member driving means for driving one of the take-up members, disposed in the sewing position by the lateral movement of the case member.

Further, in order to achieve the further object of the invention, a sewing machine in accordance with the third aspect of the invention includes in addition to the structure provided in accordance with the second aspect of the invention means for retaining the take-up members disposed in a rest position appart from the sewing position.

Other and further objects of the invention will become obvious upon gaining an understanding of the illustrative embodiments about to be described or will be indicated in the appended claims, and various advantages not referred to herein will occur to one skilled in the art upon employment of the invention in practice.

DETAILED DESCRIPTION OF THE INVENTION

An embodiment of the present invention will now be described below with reference to the drawings. In this embodiment, the present invention is applied to a multi-needle sewing machine which is provided with a plurality of sewing needles, one of which can be selected in order to change the needler thread used in the sewing.

Figure 2:
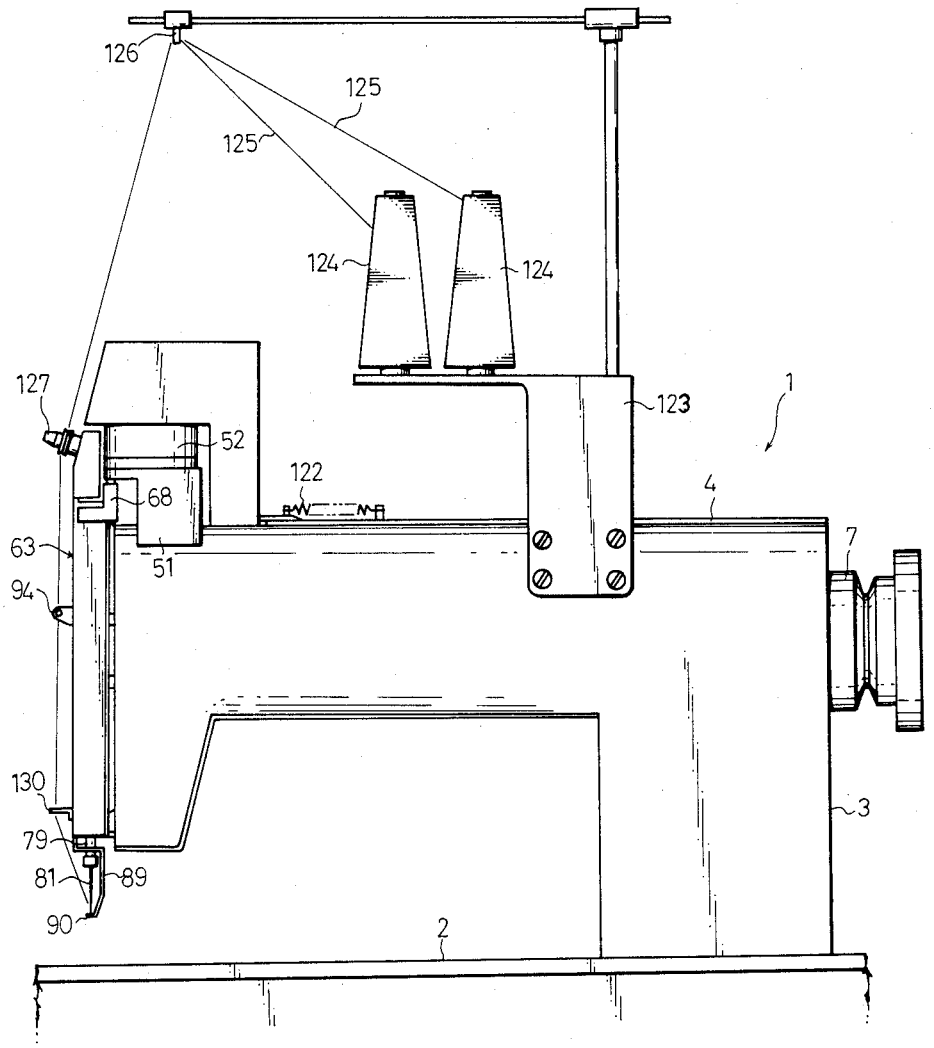
FIG. 2 is a side view showing the whole arrangement of an arm of the sewing machine shown in FIG. 1.
Figure 3:
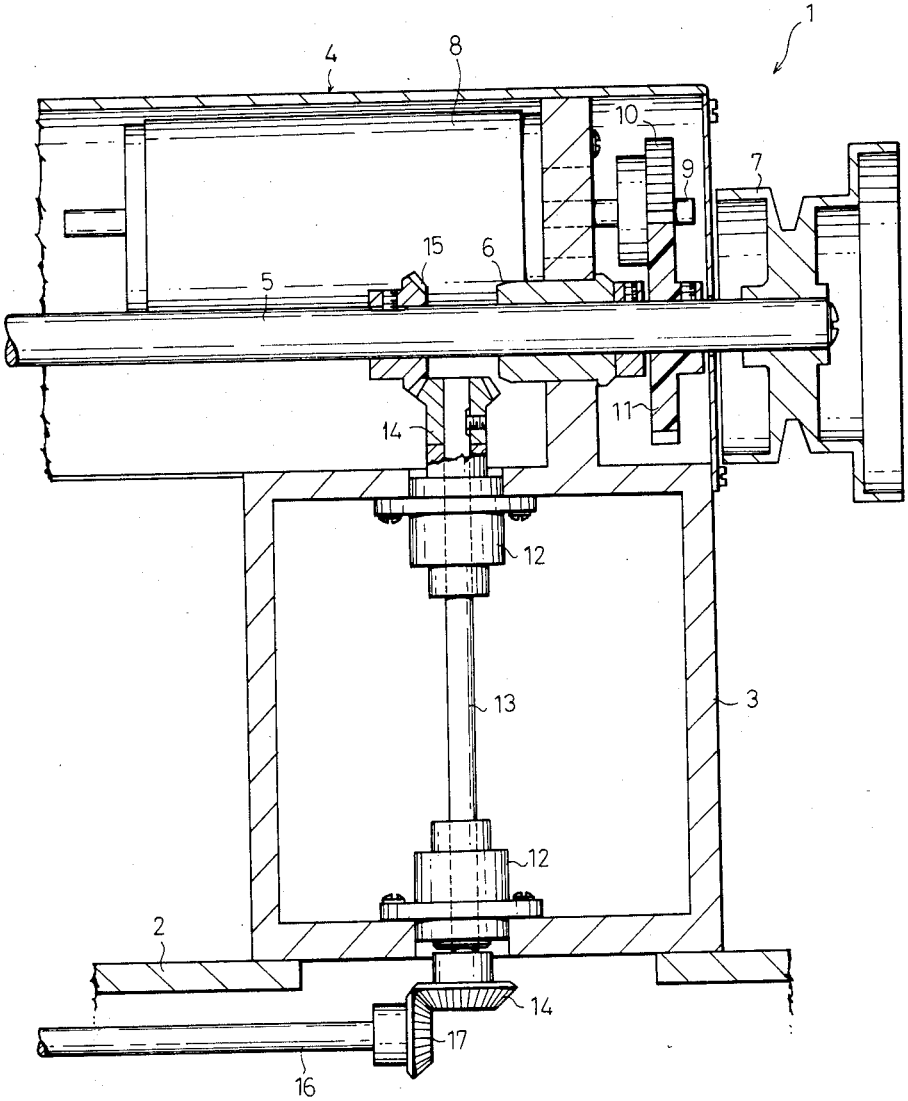
FIG. 3 is a fragmentary sectional side view of the sewing machine shown in FIG. 2, showing a driving mechanism of a machine main shaft.
Figure 4:
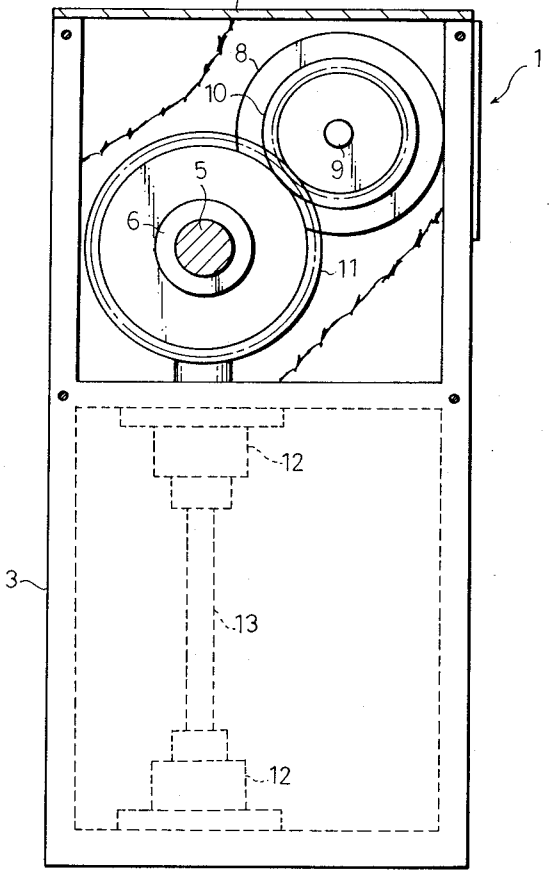
FIG. 4 is a sectional view showing a gear mechanism between the machine main shaft and a driving motor.
Figure 5:
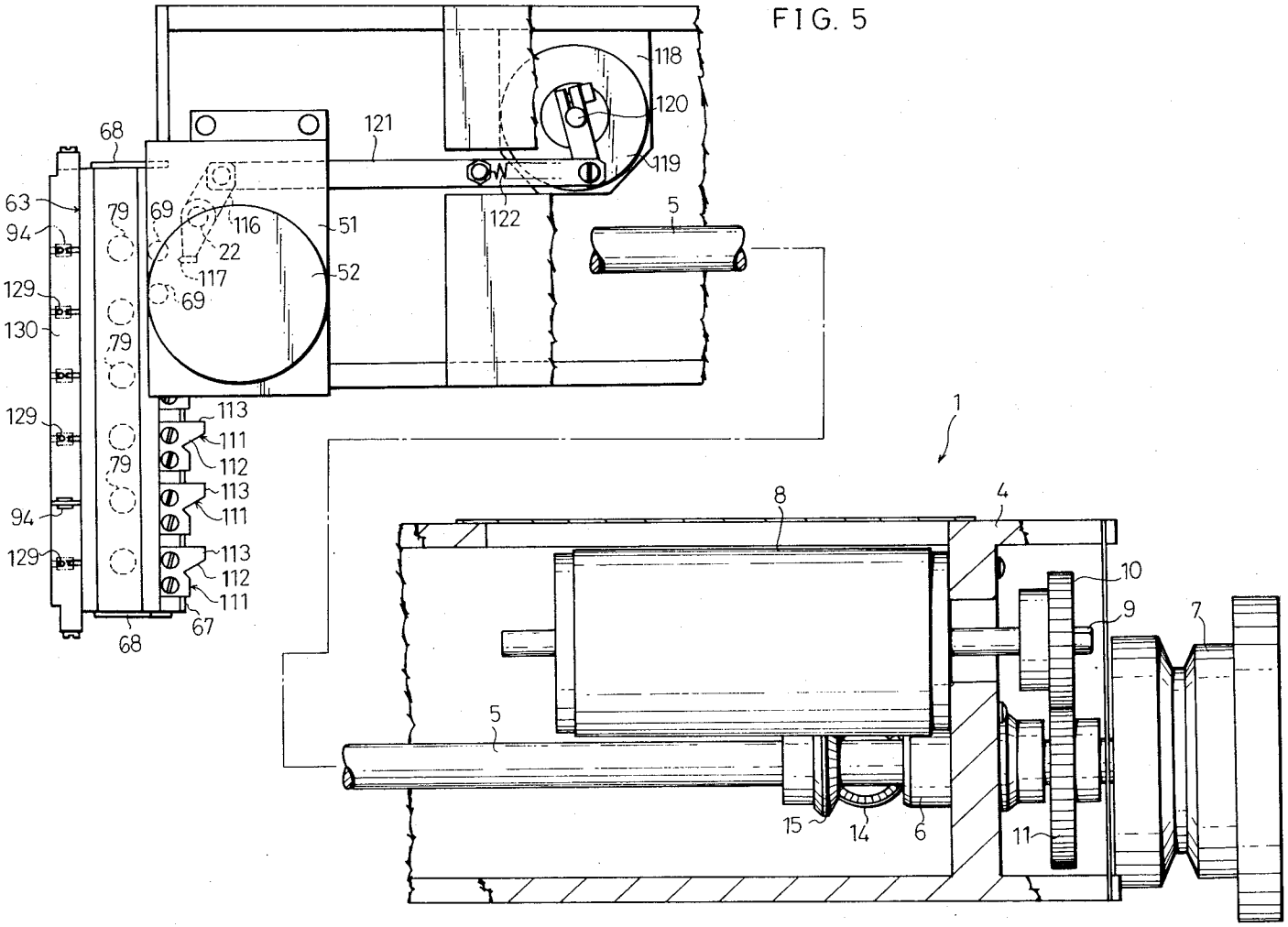
FIG. 5 is a partially broken plan view of an arm shown in FIG. 2.

As shown in FIG. 2, a frame 1 of the sewing machine comprises a bed 2, a pillar portion 3 disposed so as to stand on the bed 2, an arm 4 extending laterally from the pillar portion 3. As shown in FIGS. 3 to 5, within the arm 4, a machine main shaft 5 is rotatably supported by bearings 6 in such a manner as to extend in the horizontal direction. A handling member 7 for manually rotating the machine main shaft 5 is fixed to an end portion of the shaft 5 which is located outward of the arm 4. A machine driving motor 8, which serves as part of needle bar driving means, is fixed on the rear side of the arm 4, and a driving gear 10 is fixed to a motor shaft 9 of the motor 8. This driving gear 10 is disposed so as to engage with a follower gear 11 fixed to the machine main shaft 5 so that the machine main shaft 5 is rotated by the machine driving motor 8.

Within the pillar portion 3, a transmission shaft 13 is rotatably supported by bearings 12 in such a manner as to extend in the vertical direction. Bevel gears 14 are fixed to the upper and lower ends of the shaft 13, a bevel gear 14 fixed to the upper end being engaged with another bevel gear 15 fixed to the machine main shaft 5. An under shaft 16 is rotatably supported within the bed 2. A bevel gear 17 fixed to one end of the shaft 16 is engaged with the bevel gear 14 fixed to the lower end of the transmission shaft 13, while the other end of the under shaft 16 is connected to a thread loop taker, not shown. With this arrangement, when the machine main shaft 5 is rotated, this thread loop taker is rotated through the above transmission shaft 13 and the under shaft 16 so that a loop of the needle thread is caught.

Between the machine main shaft 5 and the arm 4, a detector (not shown) is provided for detecting the rotational position of the machine main shaft 5, and the operation of control means (not shown) connected to the detector ensures that the machine main shaft 5 can always be stopped at a predetermined rotational position.

As shown in FIGS. 1, 6, 7, and 8, a first rotary shaft 21 and a second rotary shaft 22, which each extend in the vertical direction, are rotatably supported by an upper and lower bearings 23 on the front end portion of the arm 4. Pinions 24 are fixed to each of the upper and lower ends of the first rotary shaft 21. In this specification, the left-hand side of FIGS. 1, 2, 3, 5, etc. is assumed to be the front portion, while the right-hand side of the same is assumed to be the rear portion. A lower vertical guide member 25 has cylindrical portions 26 at both ends thereof which fit around and are supported by the first and second rotary shafts 21 and 22 in such a manner as to be vertically movable. In addition, above the lower vertical guide member 25, an upper vertical guide member 27 which serves as a part of take-up member driving means has cylindrical portions 28 at both ends thereof which fit around and are supported by the first and second rotary shafts 21 and 22 in such a manner as to be vertically movable.

Figure 1:
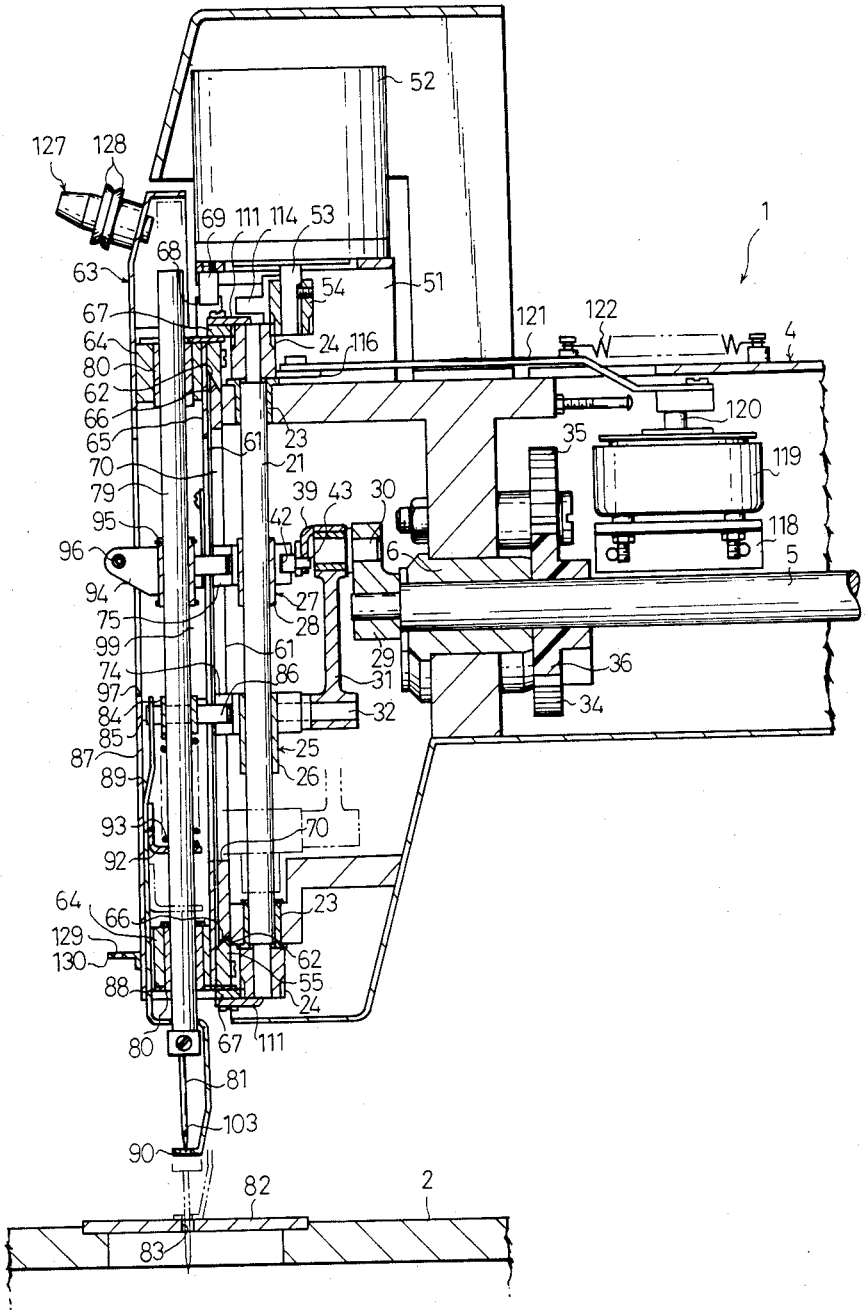
FIG. 1 is a fragmentary sectional side view showing a sewing machine to which a take-up mechanism and a needle bar selecting device in accordance with an embodiment of the invention are applied.
Figure 10:
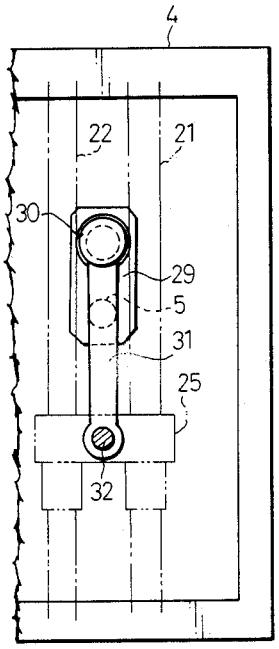
FIG. 10 is a sectional view showing a crank mechanism for driving the lower vertical guide member shown in FIG. 8.

As shown in FIGS. 1 and 10, a crank arm 29 is fixed to the front end of the machine main shaft 5, and a crank rod 31 is pivotally connected to the tip of this crank arm 29 via a crank pin 30. The crank rod 31 is connected to a pin 32 fixed to the lower vertical guide member 25. With this arrangement, when the machine main shaft 5 is rotated, the lower vertical guide member 25 is moved vertically on the rotary shafts 21 and 22 along the same by the operation of this crank mechanism. Means for driving a needle bar 79, hereinafter described, to move vertically includes the above crank rod 31, crank arm 29, motor 8, and machine main shaft 5.

Figure 9:
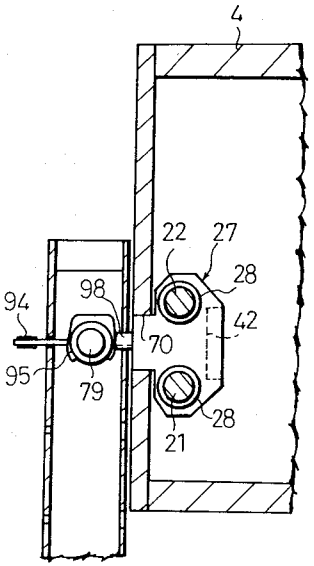
FIG. 9 is a sectional plan view showing an upper vertical guide member provided for driving take-up members.
Figure 8:
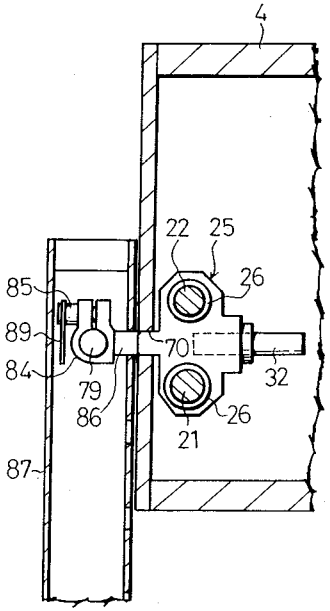
FIG. 8 is a sectional plan view showing a lower vertical guide member provided for driving the needle bars.
Figure 7:
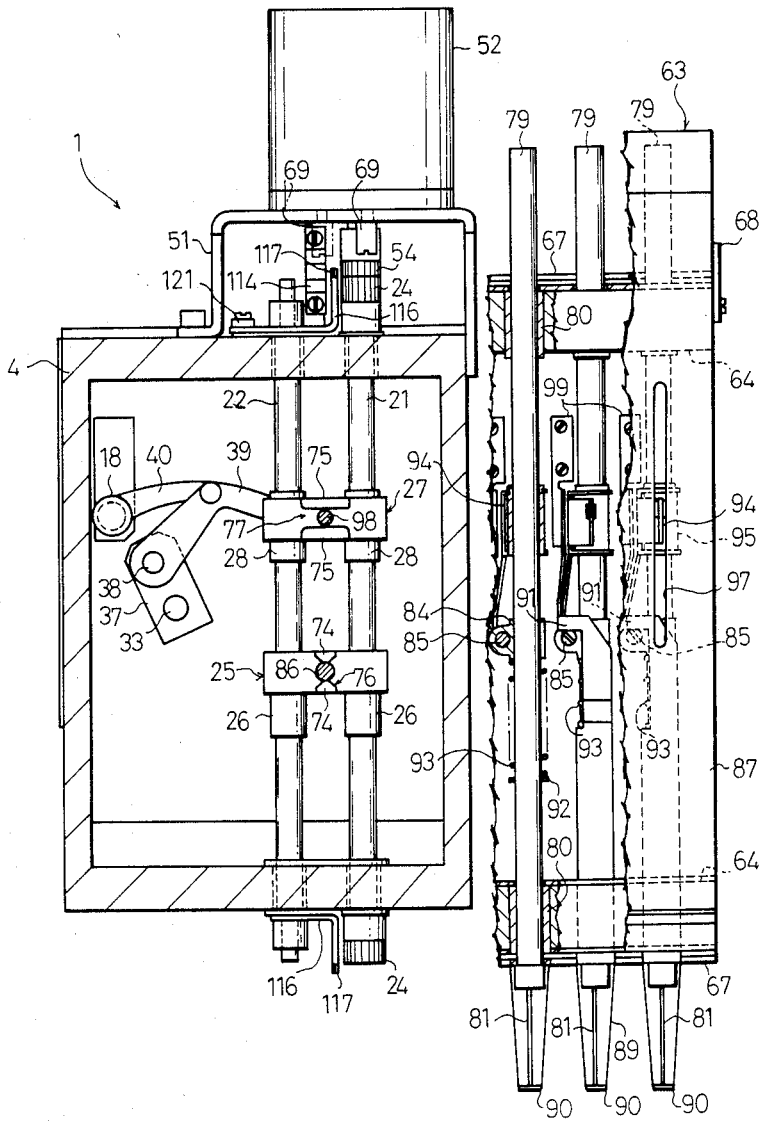
FIG. 7 is a sectional front view showing a mechanism for connecting needle bars within the case member and vertical guide members within the arm of the machine.
Figure 11:
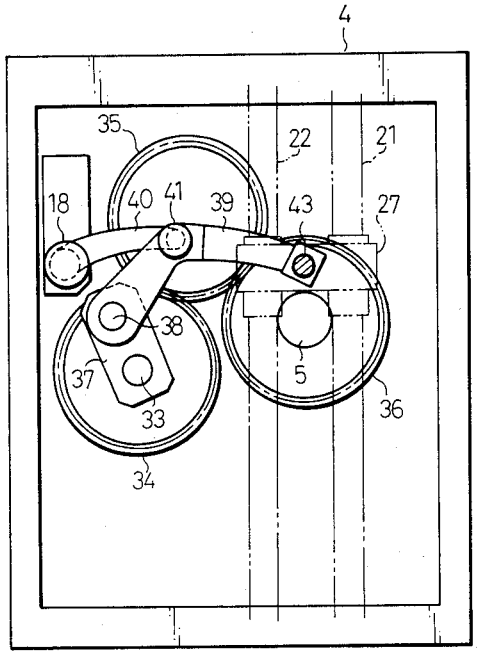
FIG. 11 is a sectional view showing a crank mechanism for driving the upper vertical guide member shown in FIG. 9.

As shown in FIGS. 1, 7, and 11, within the arm 4 in the vicinity of the machine main shaft 5, a supporting shaft 33 is rotatably supported on an axis which is parallel with the axis of the machine main shaft 5. A follower gear 34 which is fixed to the front end of the shaft 33 is connected to a driving gear 36 fixed to the machine main shaft 5, via an idling gear 35. A crank arm 37 is fixed to the rear end portion of the supporting shaft 33, and a crank rod 39 is pivotally mounted on the tip of the crank arm 37 via a crank pin 38. In addition, a supporting arm 40 pivotally supported by a portion of the arm 40 via a pin 18 has a tip which is pivotally connected to the crank rod 39 via a pin 41. Further, a pin 43 fixed to the tip of the crank rod 39 is slidably fitted in a lateral groove 42 (shown in FIGS. 1 and 9) formed in the rear surface of the upper vertical guide member 27. With this arrangement, when the machine main shaft 5 is rotated, the rotation of the main shaft 5 is transmitted to the supporting shaft 33 through the above driving gear 36, idling gear 35, and follower gear 34; and, on the basis of the rotation of the supporting shaft 33, the crank mechanism including the crank arm 37 and the supporting arm 40 moves the upper vertical guide member 27 vertically on the first and second rotary shafts 21 and 22 along the same with a timing different from that of the vertical movement of the lower vertical guide member 25. Means for driving a take-up member 94, hereinafter described, to move vertically on the needle bar 79 includes the above upper vertical guide member 27, motor 8, machine main shaft 5, gears 34 to 36, and crank arm 37.

A changeover driving motor 52 which can rotate in either the forward or reverse direction and which serves as driving means for driving a case member, hereinafter described, is fixed to the upper surface of the front end of the arm 4 via a bracket 51. A gear 54 fixed to a motor shaft 53 of the motor 52 is engaged with the pinion 24 fixed to the upper end of the first rotary shaft 21.

Figure 6:
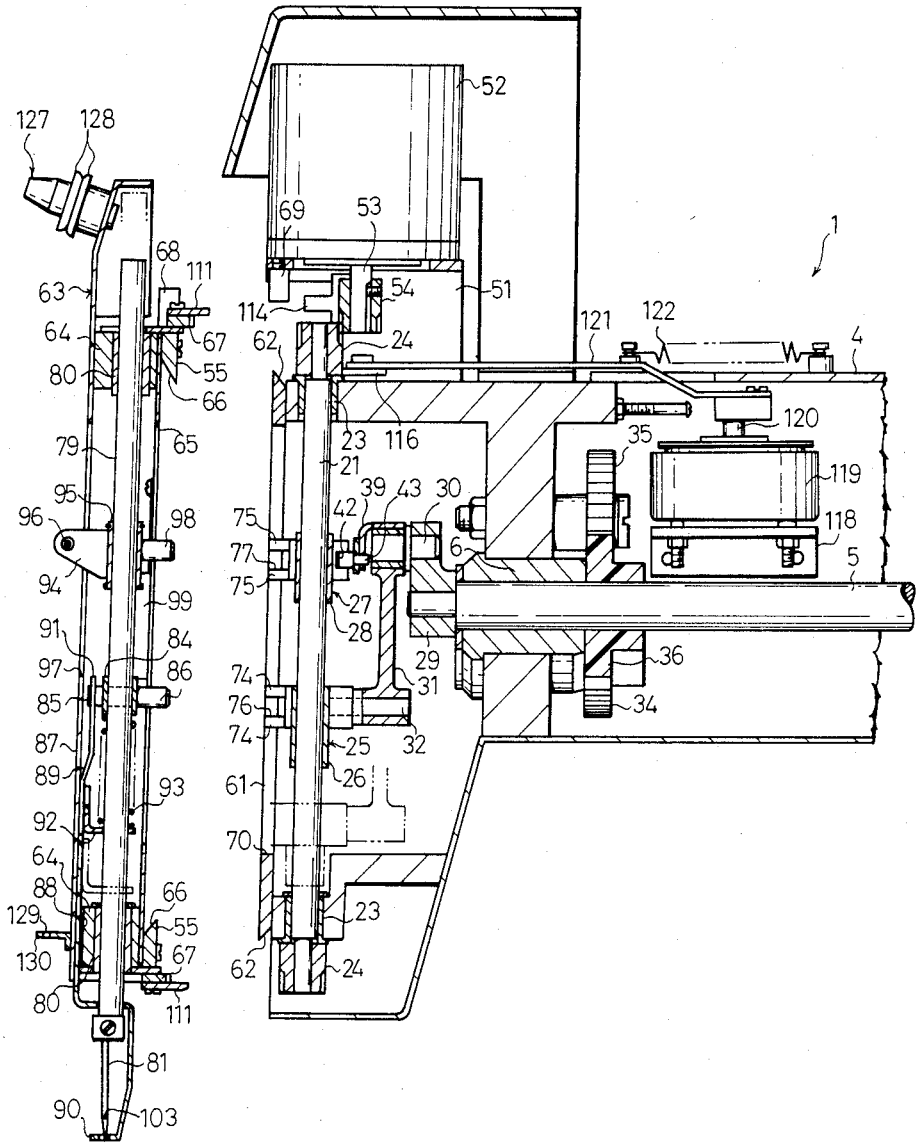
FIG. 6 is a sectional side view showing the state of a case member which has been taken out from the arm of the machine shown in FIG. 1.
Figure 13:
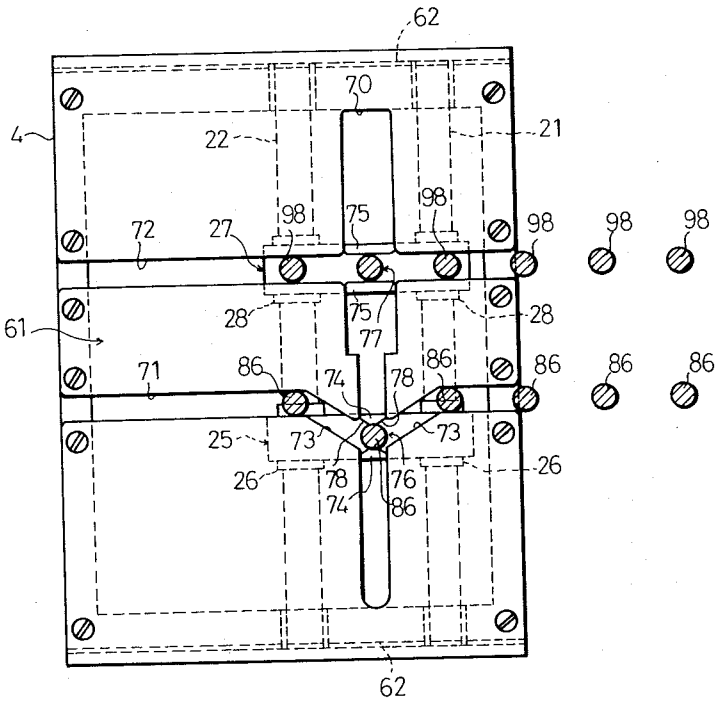
FIG. 13 is a sectional front view showing a structure for vertically guiding the needle bars and the take-up members.

As shown in FIGS. 1, 6, and 13, a lid plate 61, which is comprised of a plurality of plate members, is fixed to an opening portion at the front end of the arm 4, and dovetail guide surfaces 62 are formed on ridges along the upper and lower edges of the lid plate 61. On the front surface of this lid plate 61 is disposed a needle bar supporting case 63 which serves as a case member. The needle bar supporting case 63 has upper and lower frames 64 to which a pair of upper and lower guide members 55 are fixed via a rear cover 65 (see FIG. 6). The guide members 55 each have a guide surface 66 formed thereon which are brought into sliding engagement with the guide surfaces 62 so that the needle bar supporting case 63 is supported in such a manner as to be capable of lateral movement in the right or left direction. Racks 67 which are brought into engagement with the corresponding upper and lower pinions 24 are fixed to the corresponding upper and lower frames 64. When the changeover motor 52 is rotated in the forward or reverse direction, so that the pinions 24 are rotated either in the forward or in the reverse direction, the needle bar supporting case 63 is moved laterally to either the left or the right, respectively, through these racks 67. A limiting plate 68 (See FIGS. 5, 6) is fixed to each of the left and right ends of the upper frame 64 and is adapted to abut against one of a pair of stoppers 69 fixed to the bracket 51 when the needle bar supporting case 63 is located at the left end or the right end of its movable range, respectively, thereby preventing any disengagement of the needle bar supporting case 63 from the arm 4.

As shown in FIG. 13, the lid plate 61 is formed with a fitting groove 70 extending in the vertical direction, a lower guide groove 71, and an upper guide groove 72, the last two grooves extending laterally in such a manner as to intersect the fitting groove 70. Parts of the lower guide groove 71 located on either side of the fitting groove 70 have cam portions 73 which extend obliquely downward to the fitting groove 70. These cam portions 73 form means for driving the needle bars 79 into a rest position or a sewing position in response to the lateral movement of the needle bar supporting case 63. On the other hand, a pin holding portion 76 and a pin holding portion 77 are formed in the front surfaces of the upper and lower vertical guide members 25 and 27, respectively. The pin holding portion 76 is formed by a pair of lower protruding portions 74, and the pin holding portion 77 is formed by a pair of upper protruding portions 75, the protruding portions 74 and 75 serving as engaging portions. The pin holding portions 76 and 77 are fitted into the fitting groove 70 in such a manner as to be movable in the vertical direction. In addition, the space between the upper protruding portions 75 is arranged so as to be substantially equal to the width of the upper guide groove 72, while the space between the lower protruding portions 74 is arranged so as to be substantially equal to the width of the lower guide groove 71. The upper of the pair of lower protruding portions 74 is formed to have an inclined surface 78 which can be made to be continuous with an upper ridge between the cam portions 73.

As shown in FIGS. 1, 6, and 7, a plurality of needle bars 79, each extending in the vertical direction, are supported between the upper and lower frames 64 of the needle bar supporting case 63 by collars 80 in such a manner as to be movable in the vertical direction. In this embodiment, a total of six needle bars 79 are provided to be disposed at equal intervals. At the lower end of each of the needle bars 79 is mounted a sewing needle 81 having an eye 103. Each needle 81 is adapted to face successively the thread loop taker through a needle hole 83 formed in a throat plate 82, in accordance with the lateral movement of the needle bar supporting case 63, and the corresponding needle bar 79 is moved vertically when the needle 81 is in such a facing position (sewing position), so that the cooperation between the needle 81 and the thread loop taker ensures that lock stitches or chain stitches are formed in a work fabric or the like (not shown) placed on the machine bed 2. A sleeve 84 is fixed to each one of the needle bars 79 at substantially the vertical midpoint thereof. A stopper pin 85 and a connecting pin 86 are projected from the front surface and the rear surface of each sleeves 84, respectively. As the needle bar supporting case 63 is moved laterally, each connecting pin 86 is slidably guided within the lower guide groove 71, and also is held by the pin holding portion 76 of the lower vertical guide member 25 through the cam portions 73 of the lower guide groove 71 and the inclined surface 78, whereby the needle bar 79 and the lower vertical guide member 25 are connected so that the former is moved vertically together with the latter. When the sewing machine is stopped, the lower and upper vertical guide members 25 and 27 are adapted to stop at the upper ends of their respective vertical movement ranges. In this case, as shown in FIG. 13, the lower and upper vertical guide members 25 and 27 are arranged so as to be located respectively at the intersecting portion between the fitting groove 70 and the lower guide groove 71, and the intersecting portion between the fitting groove 70 and the upper guide groove 72. At the same time, the pin holding portions 76 and 77 of the vertical guide members 25 and 27, respectively, are arranged so as to communicate with the guide grooves 71 and 72, respectively.

As shown in FIGS. 1, 6, and 7, guide grooves 88 corresponding to each of the needle bars 79 are formed between the lower frame 64 and a surface plate 87 forming the front surface of the needle bar supporting case 63, a fabric presser 89 formed by a plate member is inserted through each of the guide grooves 88 in such a manner as to be vertically movable. At the lower end of each of the pressers 89 is formed a presser foot 90 which presses the work fabric from above. On the upper end of each fabric presser 89 (See FIG. 7) is formed a portion 91 which engages with the stopper pin 85, and a spring washer 92 is fixed to a substantially the midpoint of the presser 89. The spring washer 92 is loosely fitted on the corresponding needle bar 79, and a coil spring 93 is interposed between the spring washer 92 and the sleeve 84. When the needle bar 79 is positioned at an upper position, as indicated by solid lines in FIG. 1, the portion 91 on the upper end of the fabric presser 89 is brought into engagement with the stopper pin 85 so that the presser foot 90 is located at a height which is substantially the same as that of the tip of the corresponding sewing needle 81. On the other hand, when the needle bar 79 is moved vertically to the position indicated by dot-dot-dash lines in FIG. 1, the presser foot 90 is adapted to press against the upper surface of the work fabric and maintain its position against the force of the coil spring 93 when the needle bar 79 moves further downward.

A take-up member 94 is, at a cylindrical portion 95 thereof, supported on and fitted around each of the needle bars 79 at a position above the sleeve 84 in such a manner as to be vertically movable. The take-up member 94 has a front end portion provided with a hole 96 through which the needle thread is inserted, and this front end portion of the take-up member 94 projects outward in the forward direction through a longitudinal groove 97 formed in the needle bar supporting case 63. The take-up member 94 is provided with a connecting pin 98 extending in the rearward direction, which serves as an engaged portion to be brought into engagement with said upper protruding portions 75 (See FIG. 6). More specifically, the connecting pin 98 is moved within the upper guide groove 72 in accordance with the lateral movement of the needle bar supporting case 63, and, when the corresponding needle bar 79 is brought into a sewing position, the pin 98 is held within the pin holding portion 77 of the upper vertical guide member 27 so that the corresponding take-up member 94 and the upper vertical guide member 27 are connected. Therefore, in this state, the take-up member 94 is moved vertically in accordance with the vertical movement of the upper vertical guide member 27.

Figure 16:
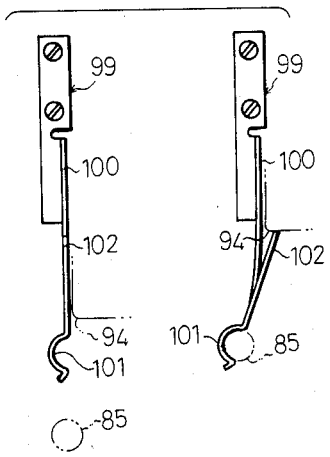
FIG. 16 is a front view showing the operation of the retaining member shown in FIG. 15.
Figure 15:
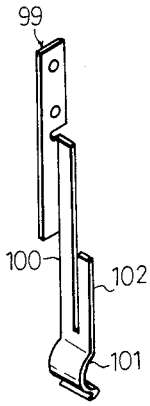
FIG. 15 is a perspective view showing a retaining member for retaining the needle bar and the take-up member in the rest position.

As shown in FIGS. 1, 6, 7, and 15, retaining members 99, each made of a plate spring and serving as retaining means, are fixed to the inner surface of the rear cover 65 of the needle bar supporting case 63 to correspond to each of the needle bars 79. Each of the retaining members 99 is provided with a spring piece 100 which extends downward. On the lower end of the spring piece 100 is formed an engagement portion 101 which can be brought into elastic engagement with the stopper pin 85 on the sleeve 84. In addition, a slit is formed in the spring piece 100 to form a retaining portion 102. With this arrangement, when a needle bar 79 is positioned within the range of vertical movement for sewing, the stopper pin 85 and the take-up member 94 are respectively located downward of the engagement portion 101 and the retaining portion 102. When the needle bar 79 is brought into a rest position which is above the normal operation stroke by the operation of the cam portions 73 of the lower guide groove 71, the stopper pin 85 is brought into elastic engagement with the engagement portion 101, whereby the needle bar 79 is elastically held at the rest position. At the same time, as shown in FIG. 16, the whole of the spring piece 100 is made to curve by the engagement of the stopper pin 85 and the engagement portion 101 so that the upper end of the retaining portion 102 is made to project toward the take-up member 94 and thus engage with the take-up member 94, thereby maintaining the take-up member 94 at a rest position, the height of which is equal to that of said upper guide groove 72.

Figure 14:
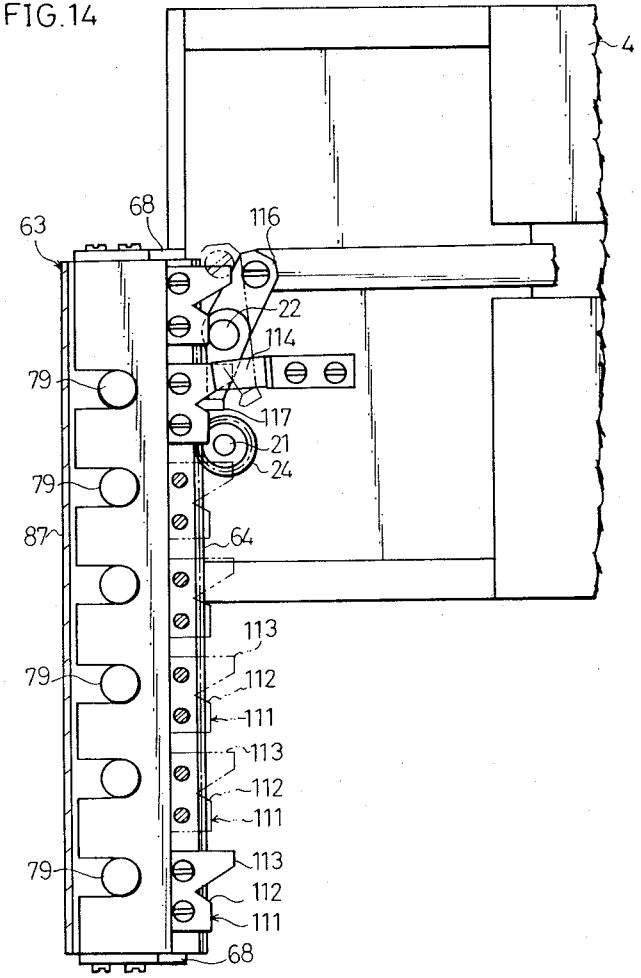
FIG. 14 is a plan view of the front end portion of the arm showing a mechanism for determining the position of the case member.
Figure 17:
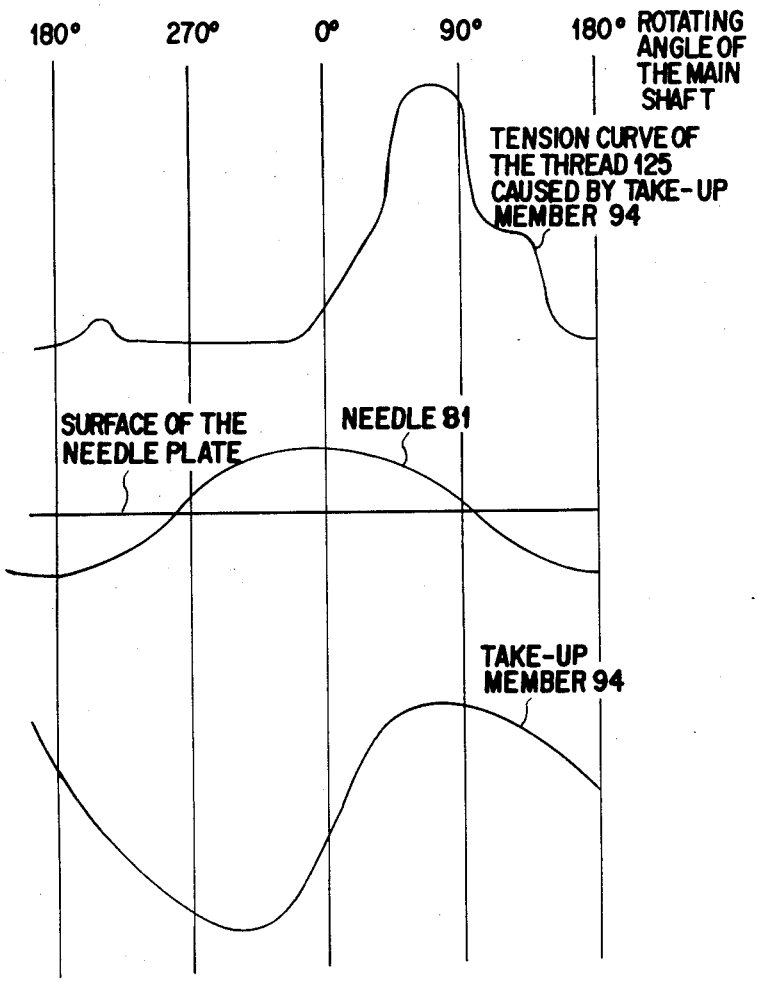
FIG. 17 is a graph showing a tension curve applied to a thread by a take-up and a needle motion curve.

As shown in FIGS. 1, 5, and 14, seven position determining members 111 are fixed to each of the upper surface of the upper frame 64 of the needle bar supporting case 63 and the lower surface of the lower frame 64 of the same at equal intervals in such a manner that each of the members 111 on the upper surface is paired with a corresponding member 111 on the lower surface, so that a total of seven pairs are provided. Six of these pairs, other than the pair shown at the top as viewed in FIG. 14, are disposed so that each pair corresponds to one of the needle bars 79. In each of the position determining members 111 is formed a position determining groove 112 which is V-shaped and opens in the rearward direction, and a projecting portion of the member 111 at the upper side thereof is formed into a detected piece 113. A photoelectric sensor 114 is fixed to the upper surface of the arm 4 in such a manner that it is located within the movement range of the detected piece 113. The photoelectric sensor 114 is adapted to detect the detected piece 113 and output an operation signal which controls the operation of the changeover driving motor 52.

A pair of determining levers 116 are fixed respectively to the upper and lower ends of the second rotary shaft 21 so as to be disposed in the vicinity of the movement range of the position determining member 111. Each of the levers 116 has a position determining pawl 117 formed at one end thereof. A rotary solenoid 119 (See FIG. 5) is fixed to the front end of the arm 4 via a bracket 118. A connection link 121 is interposed between an output shaft 120 of the solenoid 119 and the other end of each position determining lever 116. A coil spring 122 is disposed between the connection link 121 and the arm 4. With this arrangement, when the rotary solenoid 119 is energized, the position determining lever 116 is pivotally moved to a position such that the position determining pawl 117 is separated from the position determining member 111 against the force of the coil spring 122. When the rotary solenoid 119 is deenergized while one of the needle bars 79 is connected to the lower vertical guide member 25, the output shaft 120 is pivotally moved by the force of the coil spring 122 so that the upper position determining lever 116 is pivotally moved through the connection link 121 and the lower position determining lever 116 is pivotally moved simultaneously through the second rotary shaft 22 so that its position determining pawl 117 is fitted into the position determining groove 112 of the position determining member 111. This engagement of the pawl 117 with the position determining member 111 fixes the needle bar supporting case 63 in the connected condition wherein the case 63 is immovable.

Figure 12:
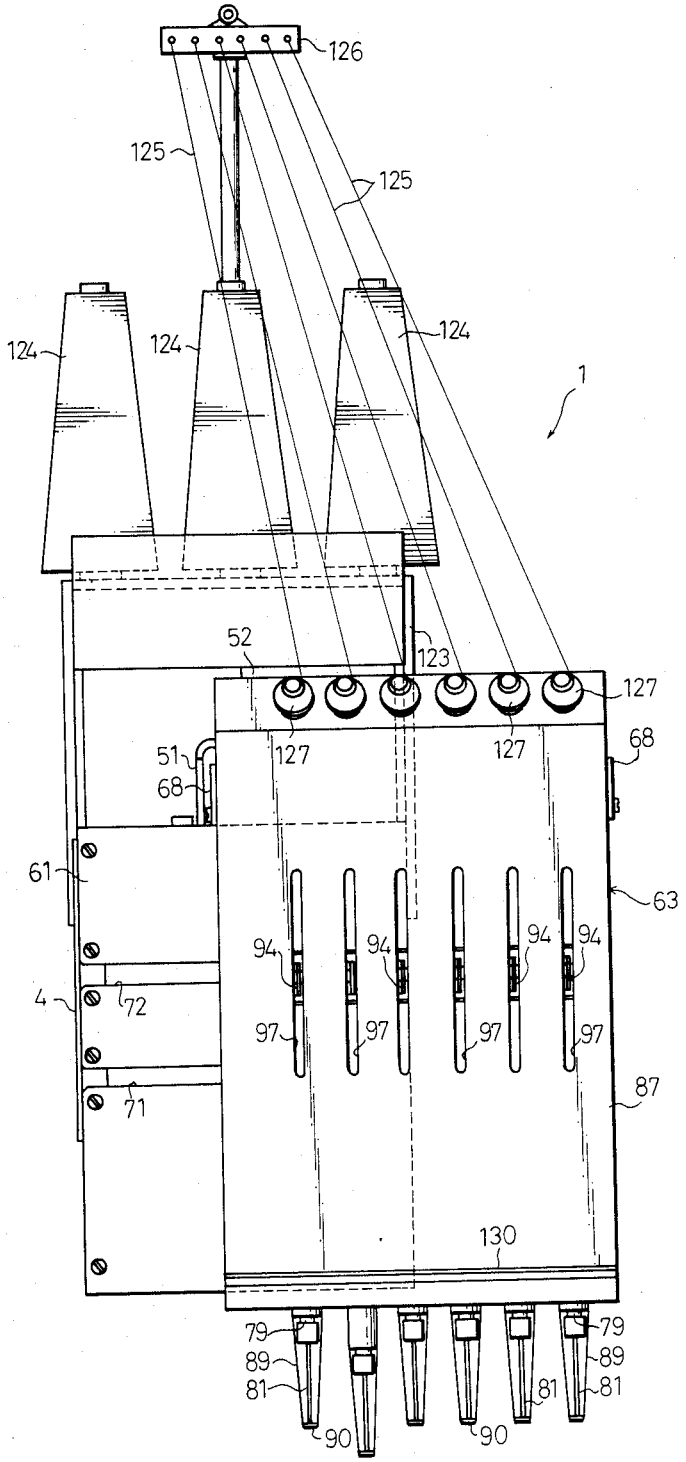
FIG. 12 is a front view showing the arm of the machine shown in FIG. 2.

As shown in FIGS. 2 and 12, a bobbin standing table 123 is fixed to the arm 4. A plurality of needle thread bobbins 124 can be exposed so as to stand on the upper surface of the table 123, each of which correspond to each of the take-up members 94, and a thread guide piece 126 for guiding needle threads 125 from the corresponding bobbins 124 toward the needle bar supporting case 63 is provided.

In addition, as shown in FIGS. 1 and 12, a total of six thread tension regulators 127, each corresponding to each of the needle bars 79, are mounted on the upper end of the surface plate 87 of the needle bar supporting case 63. The design is such that required tension is applied to each one of the needle threads 125 extending from the thread guide piece 126 to the hole 96 of each of the take-up members 94. In each of these thread tension regulators 127, a known structure having a pair of thread tension discs 128 is used. A thread guide 130 provided with a thread guide hole 129 is mounted on the lower portion of the surface plate 87 so that the needle thread 125 from the hole 96 of the take-up member 94 is guided to the eye 103 of the sewing needle 81.

The operation of the sewing machine constructed as above will now be described. At the time the machine is stopped, the rotary solenoid 119 is in the deenergized condition so that the position determining layer 116 is in engagement with the position determining groove 112 of one of the position determining members 111 by the force of the coil spring 122 through the connection link 121, whereby one of the needle bars 79 and one of the take-up members 94 which correspond to the one position determining member 111 are positioned at such sewing positions as to be connected to the lower vertical member 25 and the upper vertical guide member 27, respectively.

In this condition, when the machine main shaft 5 is rotated by the operation of the machine driving motor 8, the lower vertical guide member 25 is vertically moved on the first and second rotary shafts 21 and 22 through the crank mechanism including the crank arm 29, so that the needle bar 79 is also moved vertically along the first and second rotary shafts 21 and 22. In addition, by the rotation of the machine main shaft 5, the supporting shaft 33 is rotated through the driving gear 36, the idling gear 35, and the follower gear 34. The upper vertical guide member 27 is vertically moved with a timing which is different from that of the movement of the lower vertical guide member 25 by the operation of the crank mechanism including the crank arm 37 and the supporting arm 40 which is drived by the rotation of the shaft 33. As a result, the take-up member 94 is vertically moved on the needle bar 79 through the connection between the pin holding portion 77 and the connection pin 98. In this way, stitches are formed on the work fabric by the needle 81 and the thread loop taker, and at the same time, the needle thread is taken up by the take-up member 94 thus applying tension to the thread forming the stitches.

Next, the selecting operation of the thread for selecting an optional thread is done in the following manner. First, by the operation of the control means, the rotation of the machine driving motor 8 is stopped so that the upper and lower vertical guide members 25 and 27 are stopped at their respective positions shown in FIG. 13. Therefore the needle bar 79 is stopped at an upper needle position and the take-up member 94 is stopped at the upper end of its vertical movement range. In addition, substantially simultaneously with the above stoppage, within the bed 2, a thread cutting device (not shown) cuts the needle thread 125. Next, the rotary solenoid 119 is energized so that the upper position determining lever 116, the second rotary shaft 22 and the lower position determining lever 116 are pivotally moved through a connection link 121 as indicated by dot-dot-dash lines in FIG. 14, and the pawls 117 are separated from the position determining members 111, whereby the needle bar supporting case 63 is removed from the fixed condition. Subsequently, the changeover driving motor 52 is rotated either in the forward or in the reverse direction, and the needle bar supporting case 63 is moved either in the left or in the right direction by the rotation of the pinions 24 through the racks 67. By this movement of the needle bar supporting case 63, the connection pin 86 of the needle bar 79 is moved from the pin holding portion 76 of the lower vertical guide member 25 to the cam portion 73 of the lower guide groove 71. By the operation of the cam portion 73, the needle bar 79 is moved upward to the upper rest position which is above its vertical movement range for sewing. By this upward movement of the needle bar 79, the stopper pin 85 is brought into elastic engagement with the engaging portion 101 of the corresponding retaining member 99, thereby maintaining the needle bar 79 at the rest position apart from the sewing position. In addition, the spring piece 100 is made to curve so as to make the retaining portion 102 face the lower end surface of the take-up member 94, thus supporting the member 94 from below. Therefore, even when the connecting pins 86 and 98 of the needle bar 79 and the take-up member 94, respectively, disengage from the lower and upper guide grooves 71 and 72, respectively, by the lateral movement of the needle bar supporting case 63, the needle bar 79 and the take-up member 94 are maintained at the rest positions.

When the needle bar supporting case 63 is thus moved and the detected piece 113 corresponding to a required one of the needle bar 79 is then detected by the photoelectric sensor 114, the rotation of the changeover motor 52 is stopped, thereby stopping the lateral movement of the needle bar supporting case 63. The rotary solenoid 119 is then deenergized, and the position determining lever 116 is pivotally moved by the force of the coil spring 122 brought into engagement with the position determining groove 112 of the position determining member 111 corresponding to the required needle bar 79, whereby the needle bar supporting case 63 become fixed. On the other hand, while the needle bar 79 is moved to the sewing position from the non-sewing position, it is moved to a position to be connected to the lower vertical guide member 25 at the pin holding portion 76 thereof by the operation of the cam portion 73. In addition, the take-up member 94 corresponding to this needle bar 79 is moved to a position to be connected to the upper vertical guide member 27. Therefore, when the machine main shaft 5 is rotated by the machine driving motor 8 as mentioned above, the needle bar 79 and the corresponding take-up member 94 are vertically moved to perform the sewing by using another needle thread 125.

Incidentally, when the needle bar supporting case 63 is moved downward as viewed in FIG. 14, and the position determining pawl 117 is brought into engagement with the position determining member 111 at the top as viewed in FIG. 14, whereby when the needle bar supporting case 63 is fixed at this position, all the needle bars 79 become disengaged from the lower vertical guide member 25 to be brought into the rest position, and at the same time, all the take-up members 94 become disengaged from the upper vertical guide member 27 to be maintained at the upper positions.

As many apparently widely different embodiments of the invention may be made without departing from the spirit and scope thereof, it is to be understood that the invention is not limited to the specific embodiment thereof except as defined in the appended claims.

We claim:

1. A sewing machine with thread take-up mechanism, said sewing machine comprising:

a frame;

a needle bar movably supported on said frame in the vertical direction and having a sewing needle at the lower end thereof;

means for driving said needle bar;

a take-up member movably supported on and fitted around said needle bar and having a hole for a needle thread; and means for driving said take-up member with a timing different from that of the vertical movement of said needle bar.

2. A sewing machine with thread take-up mechanism, said sewing machine comprising:

a frame;

a case member movably supported on said frame in the lateral direction;

a plurality of needle bars each movably supported on said case member in the vertical direction and each having a needle at the lower end thereof;

a plurality of take-up members each movably fitted around a respective one of said needle bars and each having a hole for a needle thread, case member driving means for laterally moving said case member in order to bring one of said plurality of needle bars and one of said take-up members into a sewing position; and take-up member driving means for driving the take-up member disposed in said sewing position.

3. A sewing machine with thread take-up mechanism according to claim 2, further comprising needle bar driving means for driving one of said needle bars disposed in said sewing position by the lateral movement of said case member.

4. A sewing machine with thread take-up mechanism according to claim 3, wherein said take-up member driving means drives said take-up member with a timing different from that of the movement of said needle bar.

5. A sewing machine with thread take-up mechanism according to claim 2, further including means for retaining said take-up members disposed in a rest position apart from said sewing position.

6. A sewing machine with thread take-up mechanism according to claim 2, wherein said take-up member driving means includes a driving member which is moved in the vertical direction in synchronism with the driving of said sewing machine and which is engageable with said one take-up member in the sewing position in order to transmit the vertical movement thereof to said one take-up member.

7. A sewing machine with thread take-up mechanism according to claim 6, wherein said driving member is moved vertically along a fixed axis which is parallel to said needle bars, said driving member having an engaging portion and each take-up member having an engaged portion, said engaging portion of the driving member being disposed on the movement path of said engaged portion of the take-up member to be moved and engaging the engaged portion, said driving member being stopped when said case member is moved.

* * * * *